United States Patent [19]

Jensen

[11] Patent Number: 4,556,307

[45] Date of Patent: Dec. 3, 1985

[54] ADJUSTING APPARATUS FOR A DOCTOR BLADE STRUCTURE FOR COPY MACHINES

[75] Inventor: Steven C. Jensen, St. Paul, Minn.

[73] Assignee: Minnesota Mining and Manufacturing Company, St. Paul, Minn.

[21] Appl. No.: 679,932

[22] Filed: Dec. 10, 1984

[51] Int. Cl.[4] ..... G03G 21/00

[52] U.S. Cl. ..... 355/3 R; 355/3 DD; 118/261

[58] Field of Search ..... 355/3 DD, 3 R, 14 D; 118/203, 261, 403, 126

[56] References Cited

U.S. PATENT DOCUMENTS 2,387,929 10/1945 Monroe ..... 118/261 X 2,477,339 7/1949 Ljungquist ..... 118/203 X

*Primary Examiner*—A. T. Grimley

*Assistant Examiner*—Carl Romano

*Attorney, Agent, or Firm*—Donald M. Sell; James A. Smith; Robert L. Marben

[57] ABSTRACT

Apparatus for adjusting the position of a movable doctor blade structure. The apparatus includes a block member that presents an inclined surface to a contact made with the doctor blade structure. The block member is moved relative to the contact made with the doctor blade structure to alter the position of the doctor blade structure by rotation of a screw that is captively held in a support means and is threaded to the block member.

10 Claims, 2 Drawing Figures

ADJUSTING APPARATUS FOR A DOCTOR BLADE STRUCTURE FOR COPY MACHINES

FIELD OF THE INVENTION

The invention presented herein relates to apparatus for adjusting the position of a doctor blade structure relative to a toner carrying cylindrical member for controlling the amount of dry toner that is presented by the toner carrying member to a photoconductive imaging element.

BACKGROUND OF THE INVENTION

There are prior art arrangements which use an adjusting screw for adjusting a doctor blade structure relative to a toner carrying cylindrical member. Such arrangements use an adjusting screw that acts directly on the doctor blade to determine its position relative to the toner carrying member. Depending on the pitch of the adjusting screw threads, each revolution of the adjusting screw will provide movement of the doctor blade structure relative to the toner carrying cylindrical member in the range of 0.064 to 0.081 centimeters. This degree of adjustment is not usable for adjusting the doctor blade structure for some types of toners. The characteristics of some toners are such that a much finer adjustment control is needed than can be obtained from the use of such prior art arrangements.

SUMMARY OF THE INVENTION

The invention present herein provides apparatus that retains the convenience of using a screw type adjustment for imparting movement to a doctor blade structure to adjust it relative to a toner carrying cylindrical member and also solves the problem of providing a much smaller movement of the doctor blade for each revolution of the adjusting screw than is possible in prior art arrangements where lateral movement of the adjusting screw imparts an equal movement to the doctor blade. This is achieved witht the present invention which uses a movable, tapered block positioned at each end of the doctor blade. The doctor blade structure is movable and makes sliding contact with each of the tapered blocks. Each of the tapered blocks has a threaded hole in which an adjusting screw is received. Each adjusting screw is held captive between the legs of a "U"-shaped support means provided at each end of the doctor blade structure so no lateral movement is imparted to the screw when it is turned. Turning of an adjusting screw causes its associated tapered block to move. Movement of the tapered block causes movement of the doctor blade structure. The degree of incline presented by the tapered block plus the pitch of the adjusting screw determine the amount of movement that is imparted to the doctor blade for each revolution of the adjusting screw. The invention also utilizes a spring for each of the tapered blocks to take up any slack between the tapered block and its adjusting screw. A biasing means is also provided for keeping the doctor blade structure in contact with each of the tapered blocks. For some arrangements, it is possible to use only one adjusting apparatus for the doctor blade structure.

BRIEF DESCRIPTION OF THE DRAWINGS

The novel features and advantages of the invention presented herein will become more apparent to those skilled in the art upon consideration of the following detailed description which refers to the drawings wherein.

DETAILED DESCRIPTION

Figure 2:
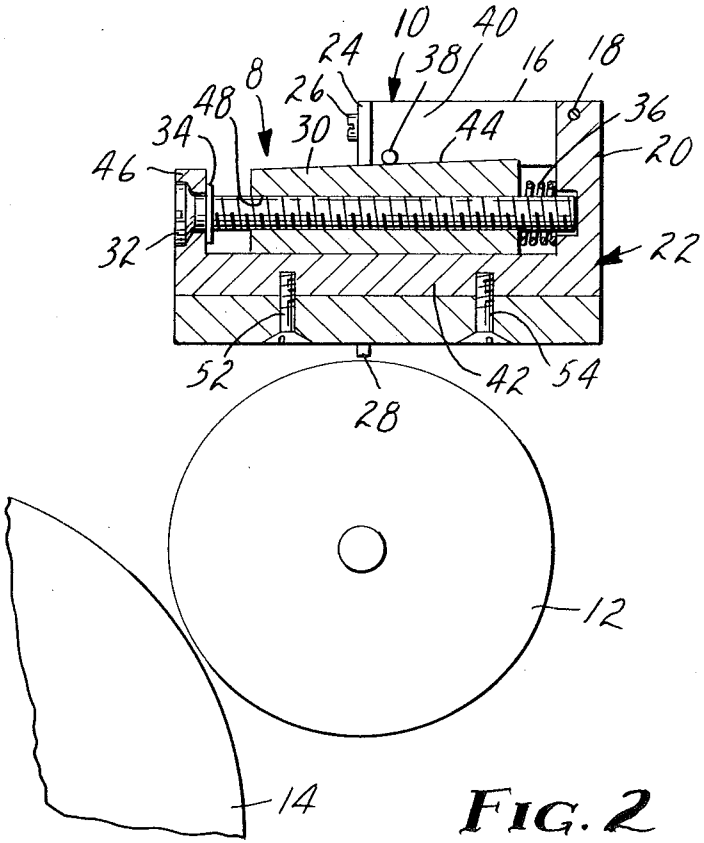
FIG. 2 is a section view of the apparatus shown in FIG. 1 taken along the line 2—2 of FIG. 1.
Figure 1:
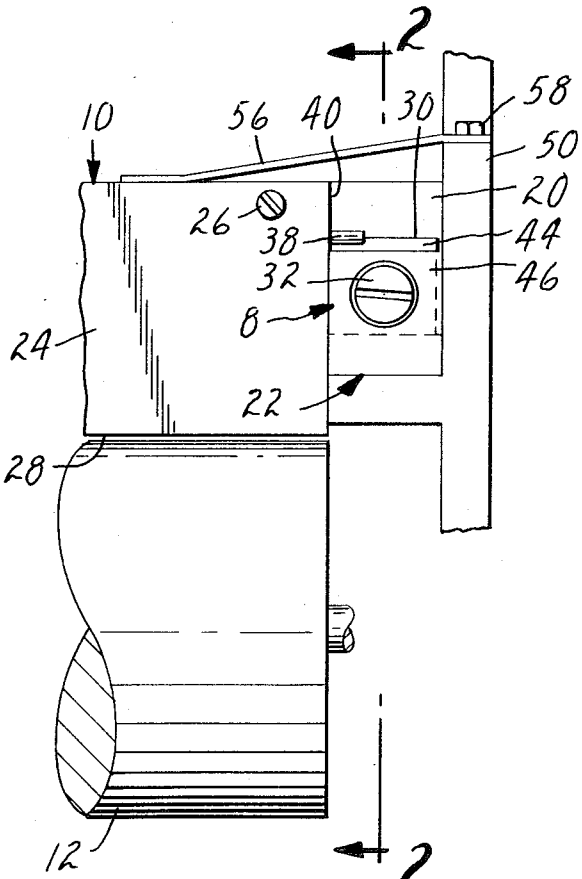
FIG. 1 is a partial view of a doctor blade structure and adjusting apparatus for adjusting the doctor blade structure relative to the cylindrical member shown positioned below the doctor blade structure.

Referring to FIG. 1, apparatus 8 is shown for adjusting the position of a pivotally mounted doctor blade structure 10 relative to a cylindrical member 12 such as are used frequently in copy machines to carry toner material to a photoconductive member 14, FIG. 2. The apparatus 8 includes a "U"-shaped support means 22. The doctor blade structure 10 includes a member 16 that is pivotally mounted at one end portion by the use of a pin member 18 extending from member 16 that is positioned in a hole provided in one leg 20 of the "U"-shaped support means 22. The doctor blade structure 10 also includes a thin plate member 24 that is attached to the member 16. Screws can be used for attaching the plate member 24 to the member 16 as indicated by the screw 26. As shown in FIG. 2, the plate member 24 extends downward from the member 16 at a generally right angle and presents a narrow surface 28 that extends parallel to the axis of the cylindrical member 12 and along the length of the cylindrical member 12. A follower member 38, which can be a round peg, extends outwardly from the side 40 of the member 16 and makes contact with the apparatus 8.

Other elements of the apparatus 8 include a tapered block 30, screw 32, retaining ring 34 and a biasing means 36, which can be a compression spring. The bottom or connecting leg 42 of the "U"-shaped support means 22 provides a flat surface on which the tapered block 30 is received. The upper surface 44 of the block 30 is inclined relative to the surface of the leg 42 on which the block 30 is positioned. The surface 44 is contacted by the follower member 38 of the doctor blade structure 8 so that the position of the block 30 along the leg 42 of the "U"-shaped support means determines the position of the edge surface 28 of the plate member 24 of the doctor blade structure relative to the cylindrical member 12. The block 30 has a hole 48 that extends for its entire length and is threaded for receiving the screw 32. The screw 32 passes through an unthreaded hole in the leg 46 of the "U"-shaped support means 22, where it is held captive by the head of the screw and a retaining ring 34, and is threaded in the hole 48 of block 30 with the end portion received in an unthreaded recess provided in leg 20 of the support means 22. The compression spring 36 is positioned about the screw 32 at the leg 20 end of the screw and is held in compression between the block 30 and the leg 20 to take up any play present between the threads in block 30 and the threads of screw 32.

A frame member 50 is provided as a part of the machine in which the doctor blade structure 10 is used. The "U"-shaped support means 22 is secured to the frame member 50 such as by screws 52 and 54 which extend through a portion of the frame member 50 and into the leg 42 of the "U"-shaped support means 22.

While not always necessary, it is desirable to use a biasing means 56 to bias the follower member 38 of the doctor blade structure 10 toward the tapered surface 44 of the block 30 so that the follower member is positively held in sliding contact with block 30. The biasing means 56 can, for example, be a flat spring member as shown in FIG. 1 which has one end fastened to the frame member 50 by a screw 58 with its other end positioned in biasing contact with the doctor blade structure 10.

FIGS. 1 and 2 show only one end of the doctor blade structure 10. It is desirable, though not necessarily required in all cases, that the other end (not shown) of the doctor blade structure 10 be supported and adjusted by the use of an apparatus as has been described for apparatus 8 in FIGS. 1 and 2.

The apparatus 8 that has been described makes it possible to provide very small movement of the edge 28 of the plate member 24 of the doctor blade structure 10 for a given movement of the adjusting screw 32. An arrangement constructed, as described in connection with FIGS. 1 and 2, can easily provide movement of the edge 28 relative to the cylindrical member 12 of about 0.01 centimeters for each revolution of the screw 32 which far exceeds the adjustment that could be made by an equal movement of an adjusting screw acting directly on the doctor blade structure.

Adjustment of the edge 28 relative to cylindrical member 12 by the doctor blade structure 10 is accomplished by first determining whether a shim having a thickness equal to the desired spacing can be placed between the end 28 and the cylindrical member 12. If the spring is not great enough, the screw 32, for the direction of the taper provided by block 10, in FIG. 2, is turned in the direction necessary to cause the block 30 to move to the left as FIG. 2 is viewed moving the doctor blade structure 16 clockwise to move edge 28 away from the cylindrical member 12. Then with the shim positioned between the edge 28 and the cylindrical member 12, the screw is rotated in the opposite direction causing movement of the block 10 to the right so that the edge 28 moves toward the shim. Once the adjustment is completed the edge 28 contacts the shim. This adjustment procedure is repeated if the apparatus 8 of FIGS. 1 and 2 is also used at the other end (not shown) of the doctor blade structure 10.

The particulars of the foregoing description are provided merely for purposes of illustration and are subject to a considerable latitude of modification without departing from the novel teachings disclosed therein. Accordingly, the scope of this invention is intended to be limited only as defined in the appended claims, which should be accorded a breadth of interpretation consistent with this specification.

What is claimed is:

1. Apparatus for adjusting the position of a movable doctor blade structure including:

a "U"-shaped support means with the connecting leg of the "U" presenting a flat surface;

a block member having a surface that is inclined relative to said flat surface, said block member positioned in sliding contact with the doctor blade structure and for movement along said flat surface, said block having a threaded hole extending through said block; and a screw member captively positioned between the legs of said "U"-shaped support means and extending through said threaded hole whereby rotation of said screw member alters the position of said block member which in turn alters the position of said doctor blade structure.

2. Apparatus according to claim 1 further including a biasing means positioned between said block member and said "U"-shaped support means to remove any play between said block member and said screw member.

3. Apparatus according to claim 1 wherein said "U"-shaped support means has a hole extending through one leg of said "U"-shaped support means, said screw member passing through said hole.

4. Apparatus according to claim 1 further including a biasing means biasing the doctor blade structure for maintaining said sliding contact between said block member and the doctor blade structure.

5. Apparatus according to claim 4 wherein said biasing means is a spring member positioned between said "U"-shaped support means and the doctor blade structure.

6. Adjusting apparatus for use in a copy machine for establishing the position of a movable doctor blade structure relative to a cylindrical member that is used to deliver toner to a photoconductive element including:

a "U"-shaped support member, one for each end of the doctor blade structure, the doctor blade structure movably mounted to extend between said "U"-shaped support members, the connecting leg of the "U"-shaped support member presenting a flat surface;

a block member, one for each of said "U"-shaped members, said block member having a surface that is inclined relative to said flat surface of said "U"-shaped member, said block member positioned in sliding contact with the doctor blade structure and for movement along said flat surface, said block member having a threaded hole extending through said block member;

a screw member, one for each of said "U"-shaped members, captively positioned between the legs of said "U"-shaped member and extending through said threaded hole in said block member whereby rotation of said screw member alters the positioned of said block member which in turn alters the position of said doctor blade structure relative to the cylindrical member.

7. Adjusting apparatus according to claim 6 further including a biasing means, one for each of said block members, positioned between said block member and said "U"-shaped support means to remove any play between said block member and said screw member.

8. Adjusting apparatus according to claim 6 wherein each of said "U"-shaped support means has a hole extending through one leg of said "U"-shaped support means, said screw member passing through said hole.

9. Adjusting apparatus according to claim 6 further including a biasing means biasing the doctor blade structure for maintaining said sliding contact between said block member and the doctor blade structure.

10. Adjusting apparatus according to claim 9 wherein said biasing means is a spring member positioned between said "U"-shaped support means and the doctor blade structure.

* * * * *